US008490459B2

(12) United States Patent
Brüggenbrock et al.

(10) Patent No.: US 8,490,459 B2
(45) Date of Patent: Jul. 23, 2013

(54) METHOD AND DEVICE FOR PRODUCING HOLLOW PROFILED ELEMENTS

(75) Inventors: Michael Brüggenbrock, Rosendahl (DE); Thomas Flehmig, Ratingen (DE); Lothar Patberg, Moers (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 1093 days.

(21) Appl. No.: 12/067,581

(22) PCT Filed: Sep. 19, 2006

(86) PCT No.: PCT/EP2006/066486
§ 371 (c)(1),
(2), (4) Date: Sep. 4, 2008

(87) PCT Pub. No.: WO2007/033957
PCT Pub. Date: Mar. 29, 2007

(65) Prior Publication Data

US 2009/0178455 A1 Jul. 16, 2009

(30) Foreign Application Priority Data

Sep. 20, 2005 (DE) ..... 10 2005 044 948

(51) Int. Cl.

| | |
|---|---|
| ***B21D 41/00*** | (2006.01) |
| ***B21D 39/08*** | (2006.01) |
| ***B21D 39/20*** | (2006.01) |
| ***B21D 22/00*** | (2006.01) |
| ***B21J 7/16*** | (2006.01) |
| ***B21J 13/00*** | (2006.01) |

(52) U.S. Cl.
USPC ..... 72/398; 72/58; 72/355.4; 72/356

(58) Field of Classification Search
USPC ..... 72/398, 58, 354.2, 355.4, 356
See application file for complete search history.

(56) References Cited

U.S. PATENT DOCUMENTS 2,158,176 A 5/1939 Dewey
4,184,355 A * 1/1980 Kozima ..... 72/327

(Continued)

FOREIGN PATENT DOCUMENTS

DE 75038 6/1894
DE 3514485 A1 10/1986

(Continued)

OTHER PUBLICATIONS

Oxford Dictionaries entry for "integrated".*

(Continued)

*Primary Examiner* — Kevin P Kerns
*Assistant Examiner* — Steven Ha
(74) *Attorney, Agent, or Firm* — Reinhart Boerner Van Deuren P.C.

(57) ABSTRACT

A device for shaping a blank into a hollow profiled element can include at least one base plate, onto which the blank that is to be shaped can be placed, at least one die core for the hollow profiled element, and at least two die halves for shaping the blank into the hollow profiled element. A method can include producing a hollow profiled element with at least one molded-on stiffening and/or functional element made from a blank. Hollow profiled elements can be produced at low cost, but at the same time ensure high reliability of a process where different hollow profiled elements are joined together by a generic device, wherein at least one form punch is provided for introducing an element structure into the planar blank that can be shaped and/or fixed into a stiffening and/or functional element.

4 Claims, 3 Drawing Sheets

U.S. PATENT DOCUMENTS

| | | | | |
|---|---|---|---|---|
| 5,239,888 | A | 8/1993 | Sevault et al. | |
| 5,749,256 | A * | 5/1998 | Bodnar | 72/333 |
| 6,012,315 | A | 1/2000 | Sekido et al. | |
| 2005/0160600 | A1 | 7/2005 | Bien et al. | |

FOREIGN PATENT DOCUMENTS

| | | | |
|---|---|---|---|
| DE | 19827798 | A1 | 12/1999 |
| DE | 10038337 | A1 | 2/2002 |
| DE | 10234253 | B3 | 4/2004 |
| EP | 0502761 | A1 | 9/1992 |
| EP | 0811436 | A1 | 12/1997 |

OTHER PUBLICATIONS

Oxford Dictionaries entry for "integrated", 2012.*
International Search Report for PCT/EP2006/066486.

* cited by examiner

METHOD AND DEVICE FOR PRODUCING HOLLOW PROFILED ELEMENTS

CROSS-REFERENCE TO RELATED APPLICATIONS

This application is a National Phase Application of International Patent Application No. PCT/EP2006/066486, filed on Sep. 19, 2006, which claims the benefit of and priority to German Patent Application No. DE 10 2005 044 948.4-14, filed Sep. 20, 2005, which is owned by the assignee of the instant application. The disclosure of each of these applications is incorporated herein by reference in its entirety.

FIELD OF THE INVENTION

The invention relates to a device for shaping a blank into a hollow profiled element comprising at least one base plate, onto which the blank that is to be shaped can be placed, at least one die core for the hollow profiled element and at least two die halves for shaping the blank into the hollow profiled element, as well as a method for producing a hollow profiled element with at least one molded-on stiffening and/or functional element made from a blank.

BACKGROUND OF THE INVENTION

For the purpose of achieving as light a weight as possible, custom-made components, which are differently dimensioned as a function of the localised load to be expected in their later service and are joined together, are used in the automotive industry but also in other technical fields. In particular so-called "tailored tubes", which are specially adapted to the different loads and must be joined together to form the support, are used as supports in the automotive industry. The method for producing such hollow profiled elements consists of butt-welding together blanks from a metallic material of various thickness and then shaping these into the hollow profiled element. In order to improve the lightweight construction method it is known from German Patent DE 100 38 337 A1 to join stiffening and/or functional elements onto a planar blank made of sheet metal and to shape the resulting blank into a hollow profiled element. For this purpose the stiffening and/or functional element must be produced separately from the blank and shaped accordingly before it is joined onto the blank, so that a further reduction in the process steps for producing hollow profiled elements, designed to meet load requirements, would be desirable.

Stiffening and/or functional elements are generally understood to mean brackets, hoops, flanges etc., which on the one hand, for example, are used for connecting other hollow profiled elements, so-called flange or connection elements. On the other hand, for example, brackets bent around 180° can also form stiffening elements by formation of an area with double the thickness of the blank.

German Patent DE 103 58 502 B3 furthermore discloses a method for producing a hollow profiled element, by means of which a connection element to join a further component is introduced into a hollow profiled element to be coiled up. The introduction of the connection elements however is to take place in a pre-formed area of the hollow profiled element, in order to ensure the dimensional precision of the connective opening that has been introduced. Because in this method the connection elements are shaped from a preformed area of the blank, this however still has residual bends. The distance between the areas of the connection elements to be joined together varies due to the residual bends. Thus the prior art connection elements do not ensure ideal joining conditions, so that reliability of the process is reduced when different hollow profiled elements are joined together.

SUMMARY OF THE INVENTION

One aspect of the present invention is to provide a method and a device for producing a hollow profiled element with at least one molded-on stiffening and/or functional element made from a blank, with which corresponding hollow profiled elements can be manufactured economically, and which at the same time ensure high reliability of the process when connecting different hollow profiled elements.

In accordance with a first teaching of the present invention the aspect indicated above is achieved by a generic device, wherein at least one form punch is provided, by means of which an element structure that is introduced into the planar blank can be shaped and/or fixed into a stiffening and/or functional element.

By integrating the form punch in the device for shaping a blank into a hollow profiled element the work stages for shaping or fixing the stiffening and/or functional elements can be combined with the work stages for shaping the blank into the hollow profiled element in one device, so that the number of work stages is reduced by avoiding additional set-up or positioning steps.

Minimization of the set-up or positioning steps is achieved in that means for punching and/or cutting the element structure into the planar blank are provided. Also, the preliminary process of punching or cutting the element structure into the planar blank can be integrated in the device by corresponding means, so that all work stages can be carried out in one device starting from a planar blank up to the finished hollow profiled element with molded-on stiffening and/or functional elements.

Preferably the means for punching and/or cutting the element structure into the planar blank are integrated at least partly in the die core, so that the structure of the device according to the invention is simplified.

The position of the individual stiffening and/or functional elements in the finished hollow profiled element can be varied particularly simply due to the fact that moveable means for cutting and/or punching are integrated in the die core.

In accordance with a second teaching of the present invention, the aspect indicated is achieved in terms of a method in which using the device according to the invention an element structure forming the later stiffening and/or functional element is introduced into the planar blank by punching and/or cutting, at least one form punch shapes and optionally fixes the element structure into the stiffening and/or functional element and then the blank is shaped into the hollow profiled element.

The stiffening and/or functional elements can be shaped according to the invention from the planar blank, so these in principle do not necessarily have residual bends and ideal joining conditions can be ensured when several hollow profiled elements produced by the method according to the invention are joined together. Furthermore tooling costs for the production of the hollow profiled elements can be kept low, since shaping always takes place in the planar blank and therefore simple tools can be designed accordingly. Finally the stiffening and/or functional elements do not have to be joined onto the hollow profiled elements, so that the number of work stages and manufacturing costs for producing a hollow profiled element with stiffening and/or functional elements can be reduced.

A further reduction in manufacturing costs is achieved in accordance with another embodiment of the method according to the invention by the fact that after the blank is placed on a base plate of a device for shaping the blank into a hollow profiled element, the form punch shapes and optionally fixes the element structure.

If punching and/or cutting of the element structure takes place in the device for shaping the blank into a hollow profiled element, all necessary work stages for producing a hollow profiled element can be carried out integrated in one device. Besides a further reduction in manufacturing costs due to shorter manufacturing times as a result of this measure, reliability of the process for producing the corresponding hollow profiled elements is also increased, since errors due to wrong positioning of the element structure are avoided from the start.

The number of necessary punching and/or cutting tools can be minimized due to the fact that punching and/or cutting of the element structure takes place through moveable means for punching and/or cutting the blank, provided in the device for shaping the blank into a hollow profiled element.

In accordance with another embodiment of the method according to the invention economic production of longitudinal seam-welded or joined pipes in average quantities is thus guaranteed due to the fact that when the blank is being shaped into the hollow profiled element, the blank is pressed by a die core against a supporting blank with a form corresponding to the hollow profiled element, laterally arranged die halves shape the hollow profiled element against the die core and optionally the opposite-lying longitudinal edges of the shaped blank are joined, more particularly welded. The method described on the one hand can produce hollow profiled elements of different lengths at low cost and on the other hand can be adapted at low cost for producing different cross-sectional shapes of the hollow profiled elements by replacing the die halves and the form punch.

If before the blank is shaped into the hollow profiled element, stiffening and/or functional elements are joined onto the blank, hollow profiled elements can be made available both with molded-on and also joined-on stiffening and/or functional elements.

BRIEF DESCRIPTION OF DRAWINGS

There is now a variety of possibilities to configure and refine the device according to the invention as well as the method according to the invention. For this purpose reference is made on the one hand to the claims and on the other hand to the description of an exemplary embodiment of the method according to the invention in conjunction with the drawing. The drawing shows in:

DETAILED DESCRIPTION OF THE INVENTION

Figure 1:
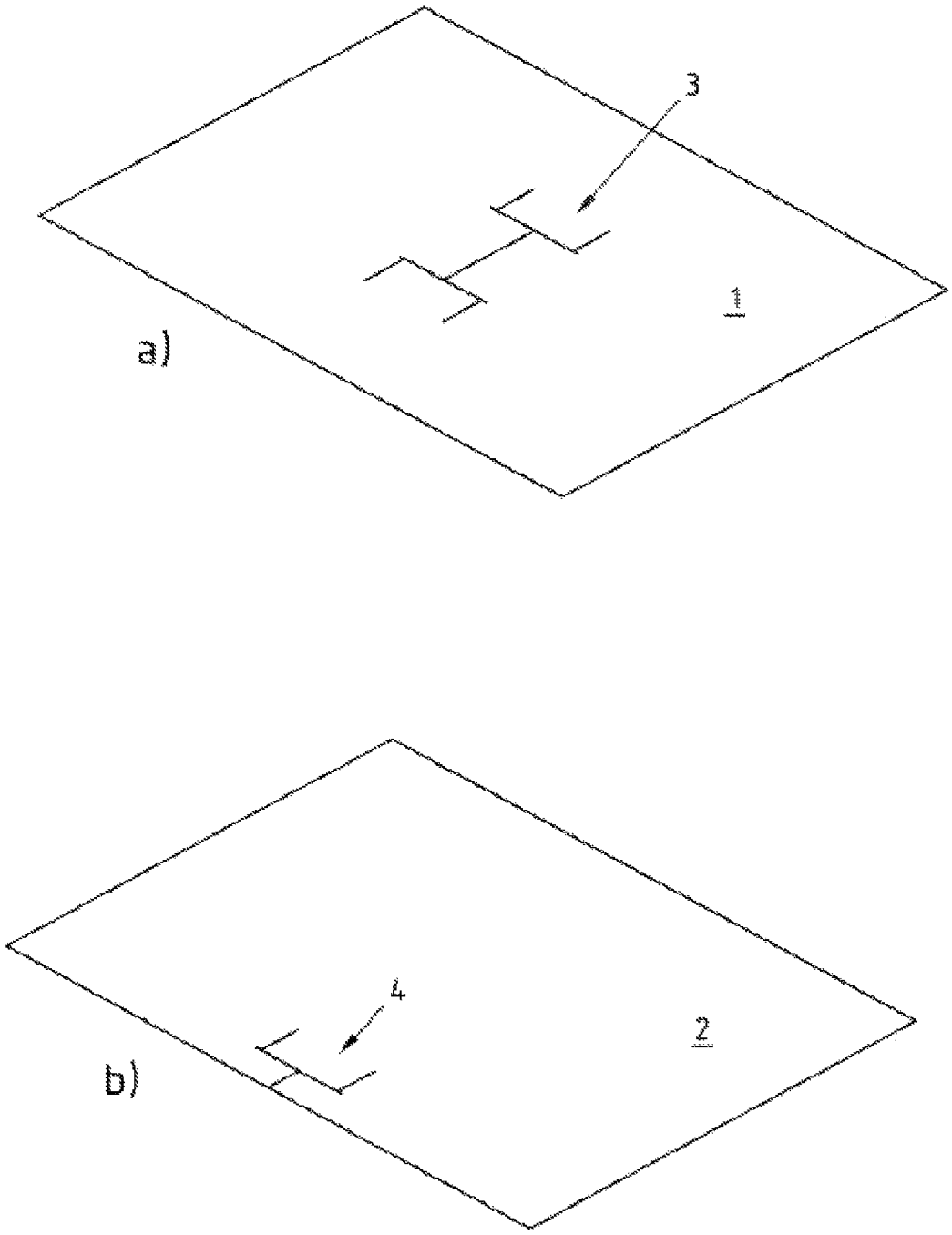
FIGS. 1 *a*) and b) in perspective view two planar blanks with element structures that have been introduced for shaping stiffening and/or functional elements in accordance with a first exemplary embodiment of the method according to the invention, FIGS. 2 *a*) and b) in perspective view the shaped hollow profiled elements made from the planar blanks in FIGS. 1 *a*) and b) and FIG. 3 in schematic sectional view an exemplary embodiment of a device according to the invention for shaping a blank into a hollow profiled element.

The blanks 1, 2 illustrated in FIGS. 1 *a*) and b) have element structures 3, 4 that have been introduced according to a first exemplary embodiment of the method according to the invention. The element structures 3, 4 normally consist of punched or cut apertures in the blanks 1, 2, which can be shaped into stiffening and/or functional elements, for example connection or flange elements.

Figure 2:
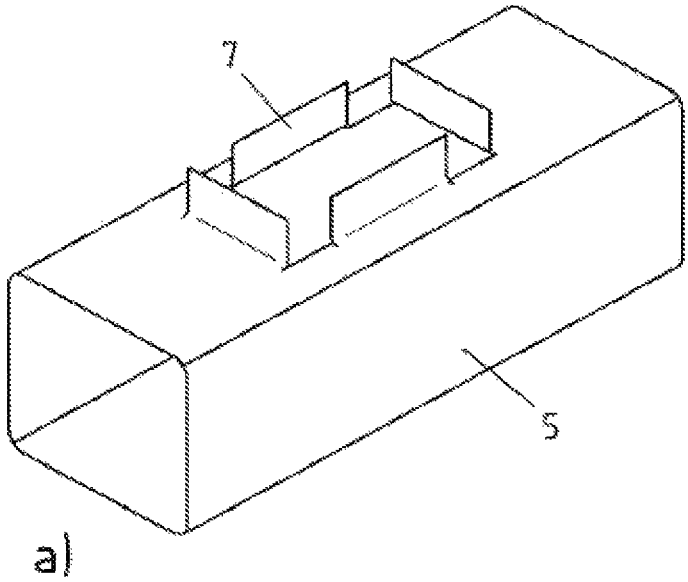
Figure 2:
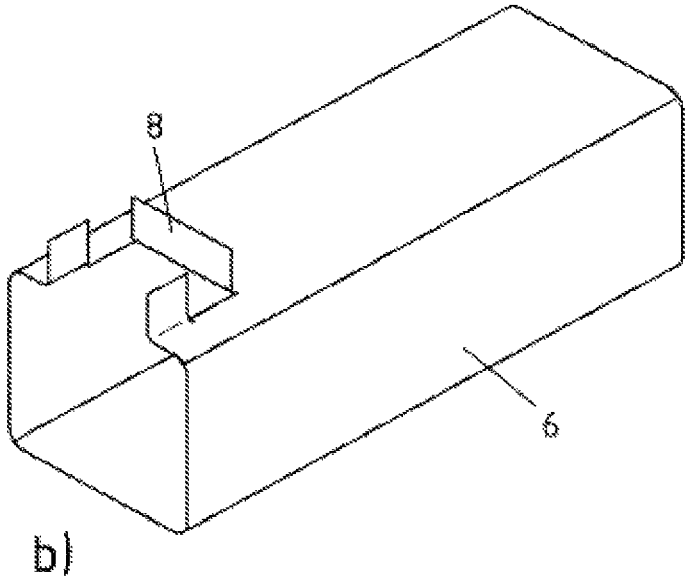

The blanks 1, 2 illustrated in FIGS. 2 *a*) and b) are shaped into a hollow profiled element 5, 6. Before actual conversion into a hollow profiled element, the element structures 3, 4 were shaped using a form punch, so that the hollow profiled element 5, 6 has a functional element, in this case a connection element 7, 8. By comparing FIGS. 1 *a*) and b) and FIGS. 2 *a*) and b) it becomes clear that the stiffening and/or functional elements can be molded on in arbitrary places on the hollow profiled element, for example on the face or in the centre of the hollow profiled element. Although FIGS. 2 *a*) and b) only show the functional elements 7, 8 formed as connection elements, a stiffening element can be easily constructed by bending the individual cut-out brackets of the element structure around 180°, so that an area with double the thickness of the blank is created.

Since the connection elements 7, 8 illustrated in FIGS. 2 *a*) and b) were shaped from the planar blank 1, 2, the brackets that have been formed are flat and show no disturbing residual bends. The connection elements 7, 8 manufactured with the method according to the invention therefore ensure ideal joining conditions for joining further hollow profiled elements.

Figure 3:
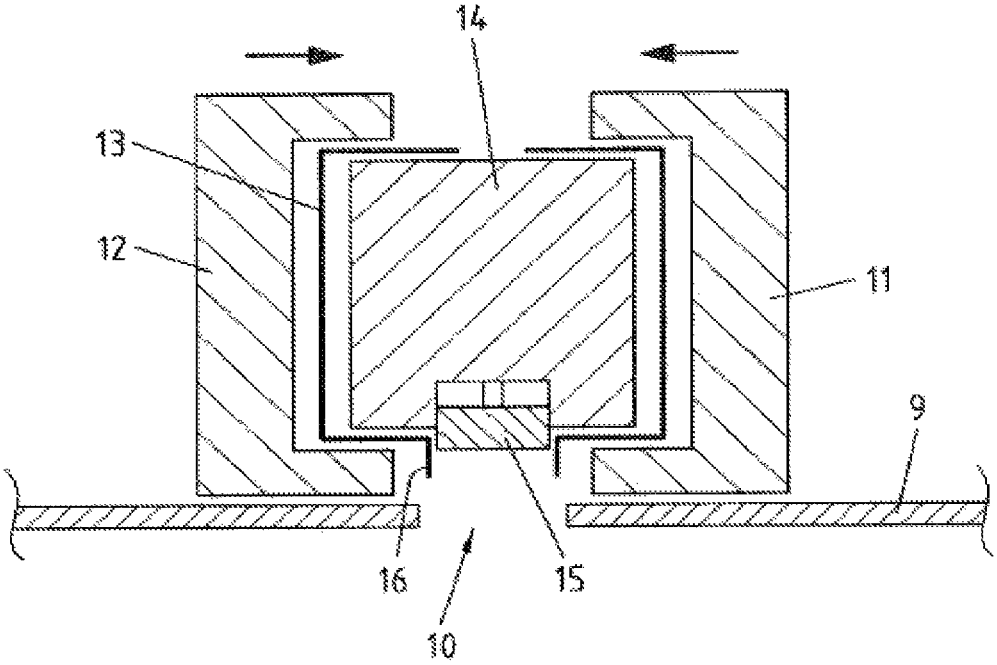

The area of the die in an exemplary embodiment of a device according to the invention for shaping a blank into a hollow profiled element is now schematically illustrated in FIG. 3 in sectional view. FIG. 3 shows a base plate 9, which has a recess 10, the recess serving to shape the element structures that have been previously introduced into the blank and not illustrated in FIG. 3. Furthermore two die halves 11, 12, which through a closing movement shape the blank 13 against the die core 14 into a hollow profiled element, for example with an almost square cross-section, are illustrated in FIG. 3. The form punch 15, which is integrated in the die core 14, serves, on the one hand, before the closing movement of the die halves 11, 12, to shape the element structures into a stiffening and/or functional element, for example connection element, the blank 13 lying on the base plate 9. In the further course of the production process the form punch 15 serves to fix the stiffening element and/or functional element 16 during shaping into a hollow profiled element.

In the case of the method according to the invention and the device according to the invention, bulkhead plates can in this way also be integrated in hollow profiled elements and in particular short brackets can be molded onto a hollow profiled element at low cost.

Preferably the die core has means, not illustrated in FIG. 3, for punching and/or cutting element structures into the blank, so that a hollow profiled element with molded-on stiffening and/or functional elements can be produced in a single process stage starting from a planar blank.

The invention claimed is:

1. A device for shaping a blank into a hollow profiled element comprising at least one base plate, onto which the blank that is to be shaped can be placed, at least one die core for the hollow profiled element, and at least two die halves each movable from the at least one die core for shaping the blank into the hollow profiled element via movement of the at least two die halves in a first direction, wherein at least one form punch is unitarily provided in the die core, by means of which an element structure that is introduced into the blank can be at least one of shaped and fixed into at least one of a stiffening and functional element through movement of the at least one form punch in a second direction transverse to the first direction.

2. The device of claim 1 further comprising at least one of a punch for punching or a cutter for cutting the element structure into the blank.

3. The device of claim 2 wherein at least one of the punch or cutter are integrated at least partly in the die core.

4. The device of claim 1 further comprising at least one moving element for at least one of cutting and punching the element structure into the blank are integrated in the die core.

* * * * *